US007385578B2

(12) United States Patent
Chang et al.

(10) Patent No.: US 7,385,578 B2
(45) Date of Patent: Jun. 10, 2008

(54) METHOD FOR WARMING-UP AN LCD (LIQUID CRYSTAL DISPLAY) SYSTEM

(75) Inventors: Ting-Jui Chang, Taipei (TW); Po-Lun Chen, Chia Yi (TW)

(73) Assignee: AU Optronics Corp., Hsinchu (TW)

( * ) Notice: Subject to any disclaimer, the term of this patent is extended or adjusted under 35 U.S.C. 154(b) by 531 days.

(21) Appl. No.: 11/070,225

(22) Filed: Mar. 3, 2005

(65) Prior Publication Data

US 2005/0227396 A1 Oct. 13, 2005

(30) Foreign Application Priority Data

Apr. 9, 2004 (TW) ..... 93109938 A

(51) Int. Cl.
*G09G 3/36* (2006.01)

(52) U.S. Cl. ..... 345/87; 345/88; 345/97; 345/98; 345/102

(58) Field of Classification Search ..... 345/87, 345/97, 88, 204, 98, 99, 102, 96, 94, 104, 345/107, 211, 212, 100; 349/40, 143, 114, 349/106; 438/149, 151, 30, 466; 361/687
See application file for complete search history.

(56) References Cited

U.S. PATENT DOCUMENTS 5,606,341 A * 2/1997 Aguilera ..... 345/87
5,773,325 A * 6/1998 Teramoto ..... 438/151
6,052,280 A * 4/2000 Dilley et al. ..... 361/687
6,335,717 B2 * 1/2002 Hasegawa et al. ..... 345/97
6,538,708 B2 * 3/2003 Zhang ..... 349/40
2001/0011979 A1 * 8/2001 Hasegawa et al. ..... 345/87
2002/0105613 A1 * 8/2002 Yamakita et al. ..... 349/143
2003/0063074 A1 * 4/2003 Kumagawa et al. ..... 345/204
2004/0056831 A1 * 3/2004 Takatori et al. ..... 345/88
2004/0160396 A1 * 8/2004 Hattori et al. ..... 345/87
2006/0246632 A1 * 11/2006 Okumura ..... 438/149
2007/0177095 A1 * 8/2007 Lee et al. ..... 349/169

* cited by examiner

*Primary Examiner*—Prabodh Dharia
(74) *Attorney, Agent, or Firm*—Troxell Law Office, PLLC

(57) ABSTRACT

A method for warming-up an LCD system which includes a pixel array having a plurality of pixel units. Each pixel unit includes a pixel electrode, and a TFT (thin film transistor) provide with a source and a gate such that a gate signal inputted into the gate can switch on and switch off the TFT so as to permit transfer of a data signal from the source to the pixel electrode. The method includes the steps: floating the source of the TFT; and applying the gate signal onto the gate which is coupled to the pixel electrode in such a manner that the pixel electrode possesses a voltage level which is substantially equal to that of the gate signal.

16 Claims, 4 Drawing Sheets

METHOD FOR WARMING-UP AN LCD (LIQUID CRYSTAL DISPLAY) SYSTEM

FIELD OF THE INVENTION

The present invention relates to a method for warming-up an OCB mode LCD system, more specifically to a method for applying a gate signal with a predetermined voltage level onto a gate which is coupled to a pixel electrode so as to result in quick transition of liquid crystal molecules of a liquid crystal layer from a splay alignment into a bend alignment.

BACKGROUND OF THE INVENTION

Advance in manufacture of TFT technology consequently brings improvement to an LCD system such that the latter can be constructed in compact size with low power consumption and lower radiation. The TFT technology is employed in manufacture of personal computers, personal digital assistances (PDA), digital watches, notebook computers, digital cameras, mobile phones, and many other consumer electronics. The manufacturers worldwide have devoted themselves to further research and thus improve the materials, processes and equipments. The qualities of the LCD system are accordingly and largely promoted while the cost goes down day-by-day, which, in turn causes a wide use of the LCD system.

In order to enhance the response speed of the screen and to widen the viewable angle of the screen, researches are conducted relating to the characteristics of the material for constructing the liquid crystal layer. Presently, three types are proposed, namely, (1) Vertical Alignment mode; (2) Lowering the viscosity ratio within the liquid crystal layer in order to assist in alteration of the initial alignment of the liquid crystal molecules to a predetermined displayable alignment; and (3) OCB (optically compensated bend) mode.

In the OCB mode LCD system, the molecules near the upper and lower glass substrates are deployed in parallel directions while the liquid crystal molecules therebetween in the liquid crystal layer are not twisted but are operated in the bent alignment state with respect to a vertical plane. Such type of bent alignment can result in fast switching retardation of light. The residual phase difference during the dark state operation can be compensated by employment of a external retardation film so as to overcome the restricted viewing angle caused due to the parallel alignment of the liquid crystal molecules on the boundaries, thereby providing a wide viewable angle. In addition, the liquid crystal molecules in the OCB mode requires a fast response time of 1-10 ms to switch between dark and bright state operation when compared to the liquid crystal molecules of the TN (twisted nematic) mode which requires a response time of about 50 ms.

Note that, though the OCB mode LCD system has the aforesaid advantage, there still exist some disadvantages, such as it requires a longer warming-up time in order to perform the transition of the liquid crystal molecules in the liquid crystal layer from the splay alignment into the bend alignment. In the presently available OCB mode of LCD system, a high voltage is generally applied onto two opposite ends of the liquid crystal layer in order to quicken the transition of the liquid crystal molecules of the liquid crystal layer from the splay alignment into the bend alignment.

Referring to FIG. 1, a circuit diagram of a pixel unit of the prior art LCD system is shown, in which a TFT (thin film transistor) serves as a switch. The TFT 10 includes a gate coupled to a gate driver 13 via a scanning line 12, a source coupled to a source driver 15 via a data line 14, and a drain coupled to an auxiliary capacitor ($C_{st}$) and a pixel electrode 16. A common electrode 17 is disposed oppositely to the pixel electrode 16. A liquid crystal layer 18 is disposed between the pixel electrode 16 and the common electrode 17. When the gate driver 13 inputs a scanning signal ($V_g$) so as to switch on the TFT 10, the data signal ($V_{data}$) from the source driver 15 can be transfer to the pixel electrode 16 via the drain such that a voltage difference between the pixel electrode 16 and common electrode 17 causes an image display on the screen.

According to the conventional LCD system, the construction design of the source driver 15 can be altered to increase the voltage level (such as from 5 to 15 volts) in order to apply a high voltage level on the pixel electrode 16 to perform the transition of the liquid crystal molecules in the liquid crystal layer 18. Alternatively, the circuit connected with the common electrode 17 can be altered in such a manner to lower the voltage level (such as from 6 to −16 volts) to result in a greater voltage difference between the pixel electrode 16 and common electrode 17. The aforesaid alteration of the source driver 15 or the circuit connected with the common electrode 17 may bring inconvenience to the manufacturers in addition to an extra production cost.

SUMMARY OF THE INVENTION

The object of the present invention is to provide a method for warming-up an OCB mode LCD system by applying a gate signal with a predetermined voltage level onto a gate which is coupled to a pixel electrode of a TFT so as to result in quick transition of liquid crystal molecules of the liquid crystal layer from a splay alignment into a bend alignment.

According to one aspect of the present invention, a method for warming-up an LCD system is proposed, wherein the LCD system includes a pixel array having a plurality of pixel units, each of the pixel units including a pixel electrode, and a TFT (thin film transistor) provided with a source and a gate such that a gate signal inputted into the gate can switch on or switch off the TFT so as to permit transfer of a data signal from the source to the pixel electrode. A common electrode is disposed oppositely to the pixel electrode. A liquid crystal layer is sandwiched between the pixel electrode and the common electrode. The warming-up method according to the present invention includes the steps: floating the source of the TFT; and applying the gate signal onto the gate which is coupled to the pixel electrode in such a manner that the pixel electrode possesses a voltage level which is substantially equal to that of the gate signal.

According to a second aspect of the present invention, a method for warming-up an OCB mode LCD system is proposed, wherein the LCD system includes a pixel array having a plurality of pixel units, each of the pixel units including a pixel electrode, and a TFT (thin film transistor) provide with a source, a drain and a gate such that a gate signal with a high or low voltage level inputted into the gate can switch on or switch off the TFT so as to permit transfer of a data signal from the source to the pixel electrode. A common electrode is disposed oppositely to the pixel electrode. A liquid crystal layer is sandwiched between the pixel electrode and the common electrode. The warming-up method of the present invention includes the steps: floating the source of the TFT during a front section of a warming-up operation, and simultaneously applying the gate signal with the high voltage level onto the gate which is coupled to the pixel electrode in such a manner that the pixel electrode possesses a voltage level which is substantially equal to that of the gate signal, wherein the pixel electrode with the voltage level enables quick transition of liquid crystal molecules in the liquid crystal layer from a splay alignment into a bend alignment; and restoring the transfer of the data signal inputting the source at a rear section of the warming-up operation, and simultaneously applying the gate signal with the high voltage level onto the gate ceaselessly, thereby permitting the transfer of the data signal from the source to the pixel electrode.

According to a third aspect of the present invention, a method for warming-up an OCB mode LCD system is provided, wherein the LCD system includes a pixel array having a plurality of pixel units, each of the pixel units including a pixel electrode, and a TFT (thin film transistor) provide with a source, a drain and a gate such that a gate signal with a high or low voltage level inputted into the gate can switch on and switch off of the TFT so as to permit transfer of a data signal to the pixel electrode via the source and the drain. A common electrode is being disposed oppositely to the pixel electrode, a liquid crystal layer being sandwiched between the pixel electrode and the common electrode, the warming-up method comprising the steps: (a) floating the source of the TFT during a front section of a warming-up operation, and simultaneously applying the gate signal with the high voltage level onto the gate which is coupled to the pixel electrode in such a manner that the pixel electrode possesses a voltage level which is substantially equal to that of the gate signal such that the pixel electrode with the voltage level enables quick transition of liquid crystal molecules in the liquid crystal layer from a splay alignment into a bend alignment; and (b) restoring the transfer of the data signal inputting the source at a rear section of the warming-up operation, and simultaneously applying the gate signal which is a pulse signal and which is formed and inputted onto the gate following a timing reference signal so as to switch the TFT on, thereby permitting the transfer of the data signal to the pixel electrode via the source and the drain.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
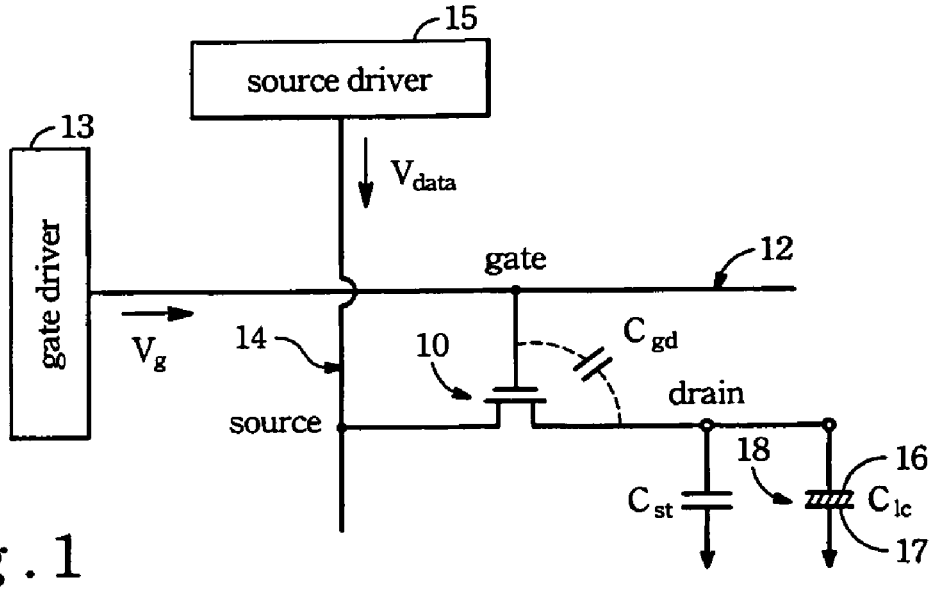
Fig. 1 (Prior Art)
FIG. 1 illustrates a schematic diagram of a pixel unit of a pixel array used in a prior art LCD (Liquid Crystal Display) system.

Before the present invention is described in greater detail with reference to the following preferred embodiments, it should be noted that same reference numerals have been used to denote similar elements throughout the specification.

A NMOS (N-channel Metal Oxide Semiconductor) transistor 10 is used to explain the spirit of the present invention, wherein when the gate driver 13 inputs a gate signal ($V_g$) with a high voltage so as to switch on the transistor 10, the data signal ($V_{data}$) inputted by the source driver 15 can be transferred to the pixel electron 16 via the source and drain of the transistor 10 so as to display an image on the screen.

Note that the voltage level of the aforesaid data signal ($V_{data}$) is about 5 volts such that when applied onto the pixel electrode 16 can not result in quick transition of the liquid crystal molecules of the liquid crystal layer into a workable display alignment. However, the gate signal ($V_g$) inputted by the gate driver 13 has a voltage level ranging between −5 to 20 voltages, and accordingly the high voltage level ($V_{gh}$) thereof is above 15 volts. In case, the gate signal with the high voltage level ($V_{gh}$) can be transferred to the pixel electrode 16, a quick transition of the liquid crystal molecules in the liquid crystal layer 18 from the splay alignment into the bend alignment results, thereby shortening the warming-up time of the LCD system.

Figure 2:
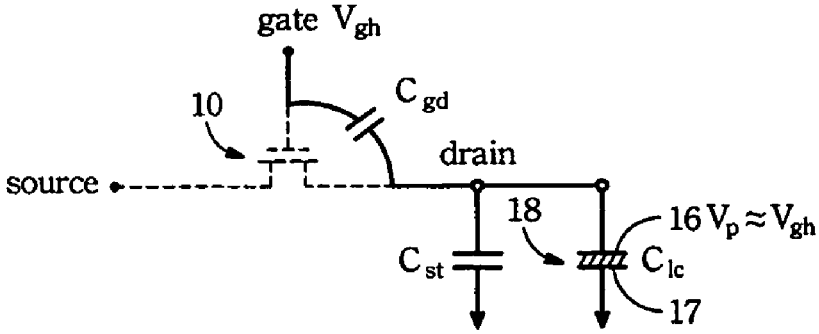
FIG. 2 illustrates the floating state of a source which is coupled to a storage capacitor via a gate and a drain of a TFT to permit transfer of gate signal with a high voltage to a pixel electrode according to the method of the present invention.

Referring to FIG. 2, in the warming-up method of the present invention, the source of the transistor 10 is disposed in a floating state so as to interrupt the transfer of the data signal ($V_{data}$) to the pixel electrode 16. A gate signal ($V_{gh}$) with the high voltage level is applied onto the gate which is coupled to the pixel electrode 16 via the parasitical capacitor (Cgd) occurring between the gate and the drain, in such a manner that the pixel electrode 16 possesses a voltage level (Vp) which is substantially equal to that of the gate signal ($Vp \approx V_{gh}$). For example, when the gate signal (Vgh) has 15 volts, the pixel electrode may have about 13.6 volts, wherein a voltage difference of 13.6 v is resulted between the pixel and command electrodes 16,17, which, in turn, causes a quick transition of the liquid crystal molecules in the liquid crystal layer 18 from the splay alignment into the bend alignment.

Figure 3:
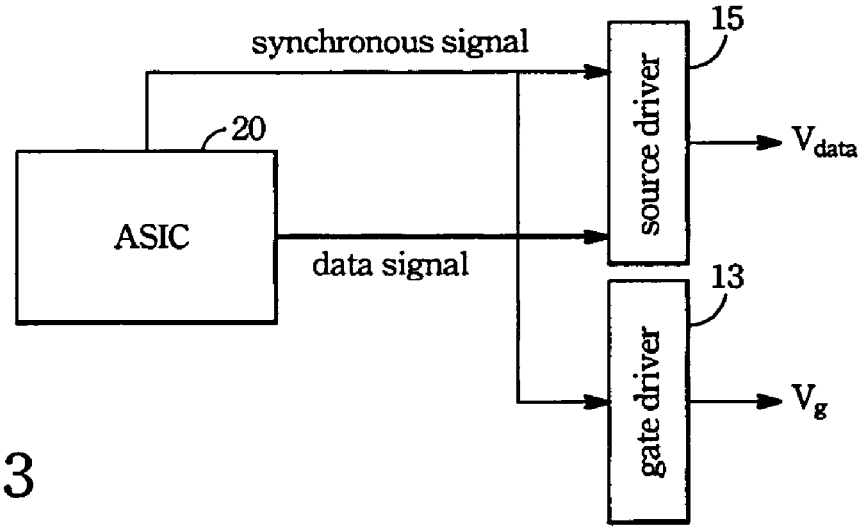
FIG. 3 shows how ASIC transmits a synchronous signal and a data signal to control the gate driver and the source driver according to the method of the present invention.

Note that no new signal drive is required to accomplish the warming-up method of the present invention. Referring to FIG. 3, in the presently available LCD system, the driving operation of the gate and source drivers 13,15 are controlled by a timing control chip 20 [also an ASIC (application-specific integrated circuit)] such that some control signals of the timing control chip 20 can be readjusted in order to achieve the required task. The timing control chip 20 can be arranged to input a synchronous signal and a data signal to the source driver 15 in such a manner to control the floating action of the source while the voltage level of the gate signal ($V_g$) inputted by the gate driver 13 can be maintained at the predetermined high level.

Figure 4:
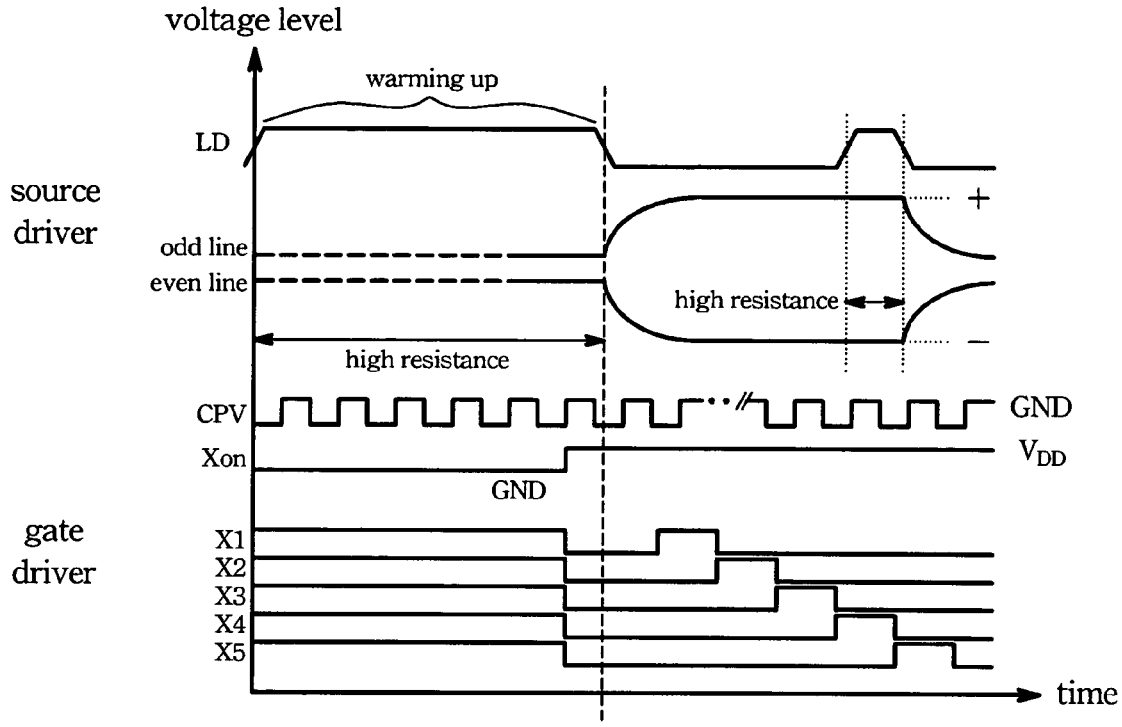
FIG. 4 illustrates the signal waveform of the source driver and the gate driver in the first preferred embodiment of the present invention.

FIG. 4 illustrates the signal waveform of the gate and data signals employed in the first preferred embodiment of the present invention. The source driver 15 is provided with pins which is adapted to transmit LD (Latch-up Data) signal such that when the LD signal is disposed at the "ON" state, the source driver 15 is being latched up. Thus during the front section of the warming-up operation of the LCD system, a high resistance is occurred on the odd and even scan lines of the source driver 15 and accordingly the transfer of the data signal to the pixel electrode is interrupted, thereby floating the source of the transistor 10.

On the other hand, the gate driver 13 is provided with pins that is capable outputting an $X_{on}$ signal for controlling the gate signal with the high voltage such that when the $X_{on}$ signal is disposed at the "OFF" state, the voltage level of the gate signal can be maintain at a predetermined high voltage level ($V_{gh}$). As shown in the drawing, during the entire length of the warming-up operation, the $X_{on}$ signals on the scanning lines (X1, X2 . . . , X5) are maintained at the "OFF" state while the voltage level ($V_{gh}$) thereof is maintained at the predetermined high voltage level. Under this condition, the source which is used for transferring the data signal ($V_{data}$) is disposed at the floating state and the voltage level of the pixel electrode 16 is occurred which is coupled to the gate signal ($V_{gh}$) via the capacitor ($C_{gd}$) i, thereby accelerating the transition of the liquid crystal molecules in the liquid crystal layer 18 from the splay alignment to the bend alignment.

Figure 5:
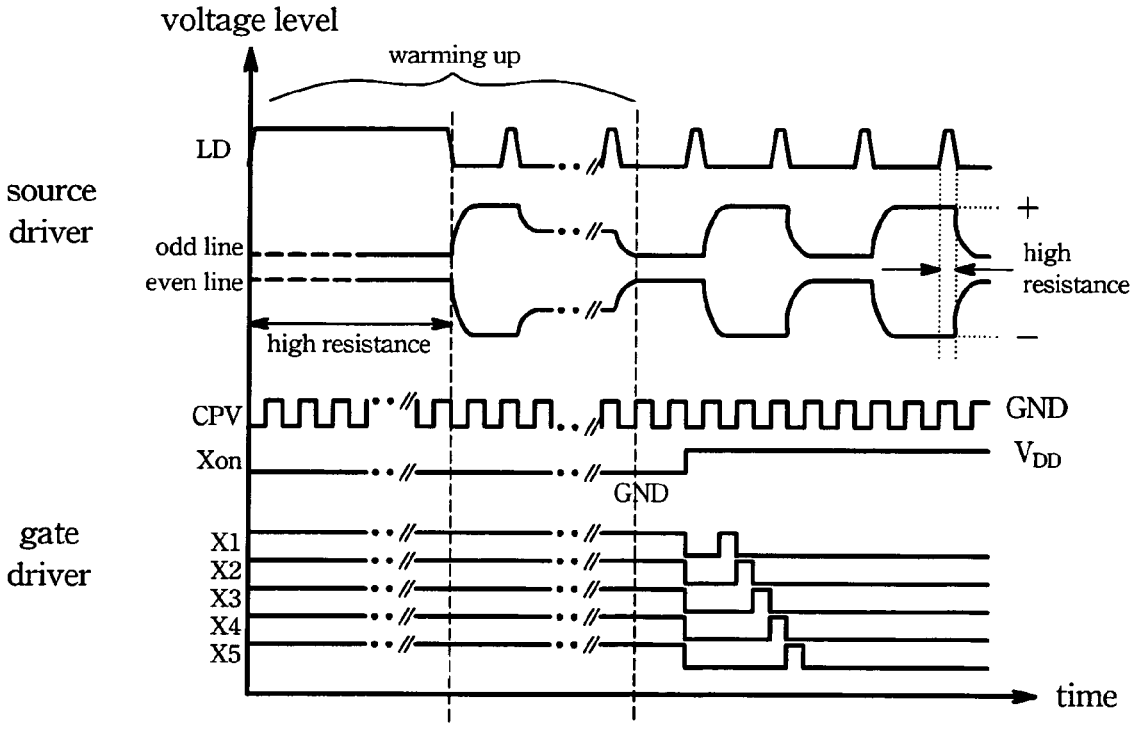
FIG. 5 illustrates the signal waveform of the source driver and the gate driver in the second preferred embodiment of the present invention.

FIG. 5 illustrates the signal waveform of the gate and data signals employed in the second preferred embodiment of the present invention. At the front section of the warming-up operation of the LCD system, the LD signal is disposed at the "ON" state so as to latch-up the transfer of the data signal, thereby disposing the source under floating state. The $X_{on}$ signal of the gate driver 13 is disposed at the " OFF" state so as to maintain the voltage of the gate signal on the scanning lines at the high voltage level.

At the rear section of the warming-up operation of the LCD system, when the $X_{on}$ signal of the gate driver 13 is disposed at the "OFF" state, the gate signal with the high voltage level is ceaselessly applied onto the gate of the transistor, in the meanwhile the LD signal is restored to the normal cycle waveform. At this time, the data output terminal of the source driver 15 is restored to normal data transfer signal from the floating state of high impedance. Thus, at the rear section of the warming-up operation, the LD signal outputted by the source driver 15 may have positive value or negative value accordingly to the odd and even scanning lines.

Figure 6:
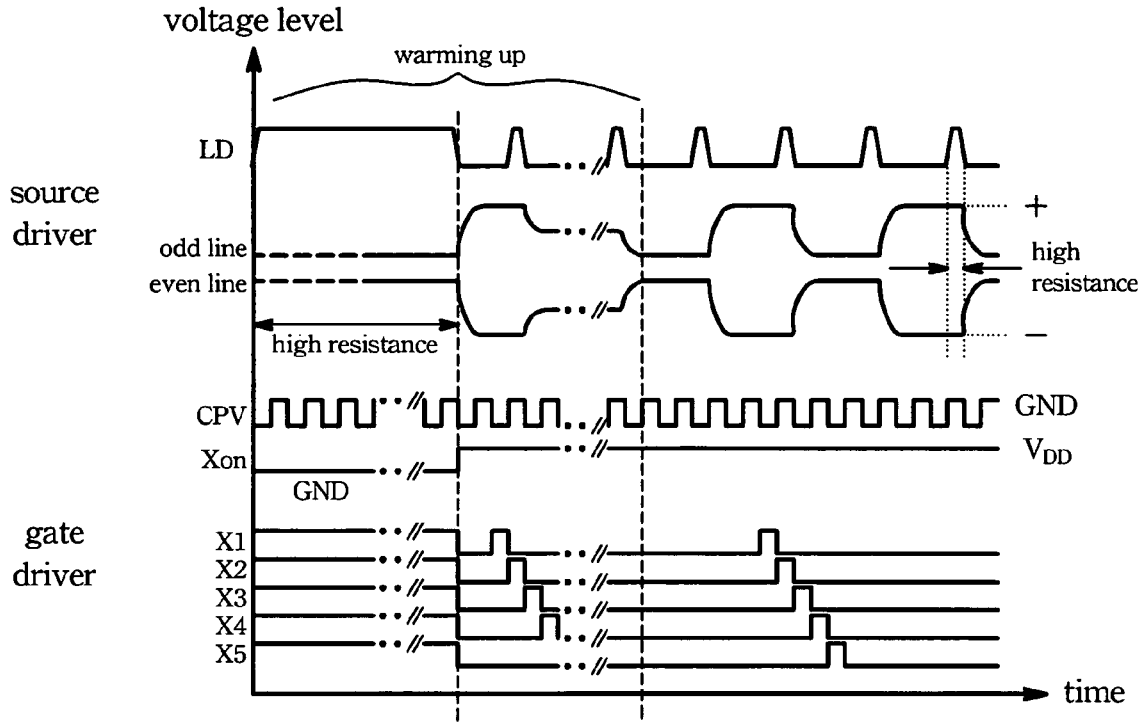
FIG. 6 illustrates the signal waveform of the source driver and the gate driver in the third preferred embodiment of the present invention.

FIG. 6 illustrates the signal waveform of the gate and data signals employed in the third preferred embodiment of the present invention. At the front section of the warming-up operation, the LD signal of the source driver 15 is disposed at the "ON" state so as to dispose the data output terminal at the floating state. Meanwhile, the $X_{on}$ signal of the gate driver 13 is disposed at the "OFF" state such that the gate signal ($V_{gh}$) on the respective scanning line (X1, X2, . . . , X5) has the high voltage level.

Upon reaching the rear section of the warming-up operation, the $X_{on}$ signal of the gate driver 13 is disposed at the "ON" state, meanwhile all the scan lines (X1, X2, . . . X5) are maintained at a low voltage level (Vgl). Then, following the cycle waveform of the timing reference signal (CPV), those scan lines (X1, X2 . . . . X5) input the pulse of the gate signal (Vgh) one by one. Namely, the operation of the gate driver is restored in such a manner to scan the scan lines (X1, X2, . . . , X5) one by one so as to switch on or off the TFTs on each scan line. In the similar manner, the LD signal of the source driver 15 is restored to the normal cycle waveform so as to alter the data output terminal from the floating state to the normal data transfer state.

Figure 7:
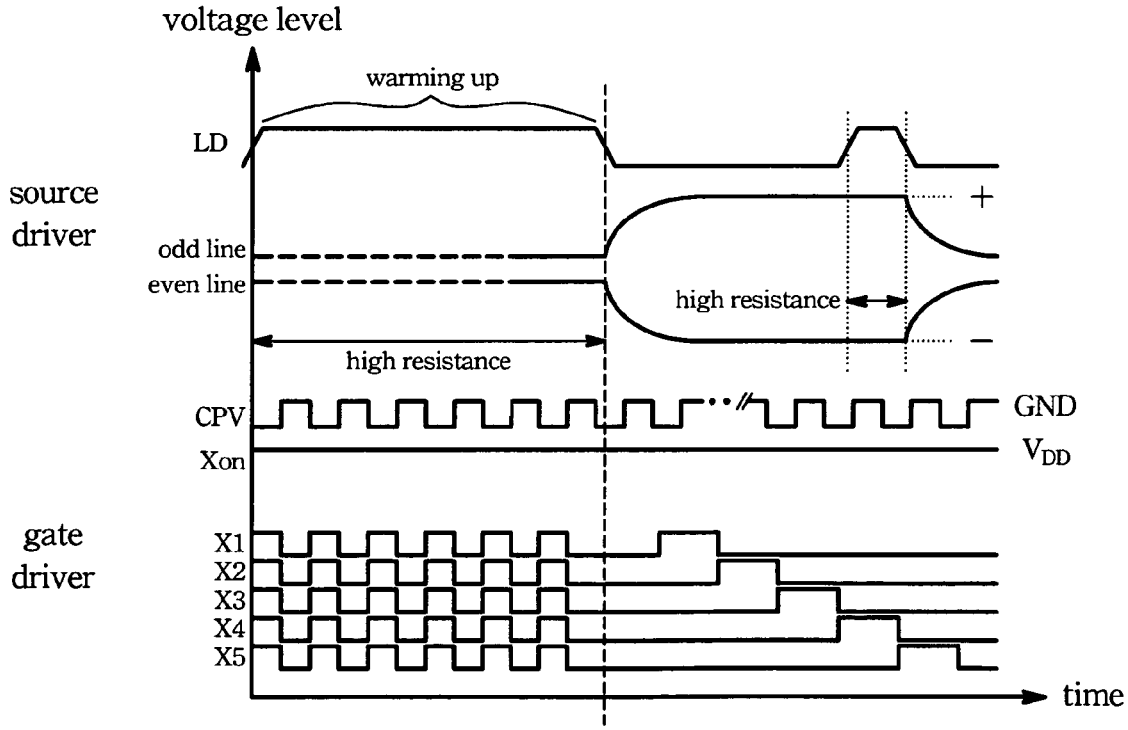
FIG. 7 illustrates the signal waveform of the source driver and the gate driver in the fourth preferred embodiment of the present invention.

FIG. 7 illustrates the signal waveform of the gate and data signals employed in the fourth preferred embodiment of the present invention. Throughout the warming-up operation of the LCD system, the data output terminal (the odd and even scan lines) of the source driver 15 is disposed at the floating state while the gate signal of cycle waveform pulsating between the high and low voltage level ($V_{gh}/V_{gl}$) is outputted by the gate driver 13 such that the pixel electrode is provided with high or lower voltage level alternatively, thereby permitting the transition of the liquid crystal molecules in the liquid crystal layer from the splay alignment into the bend alignment.

Figure 8:
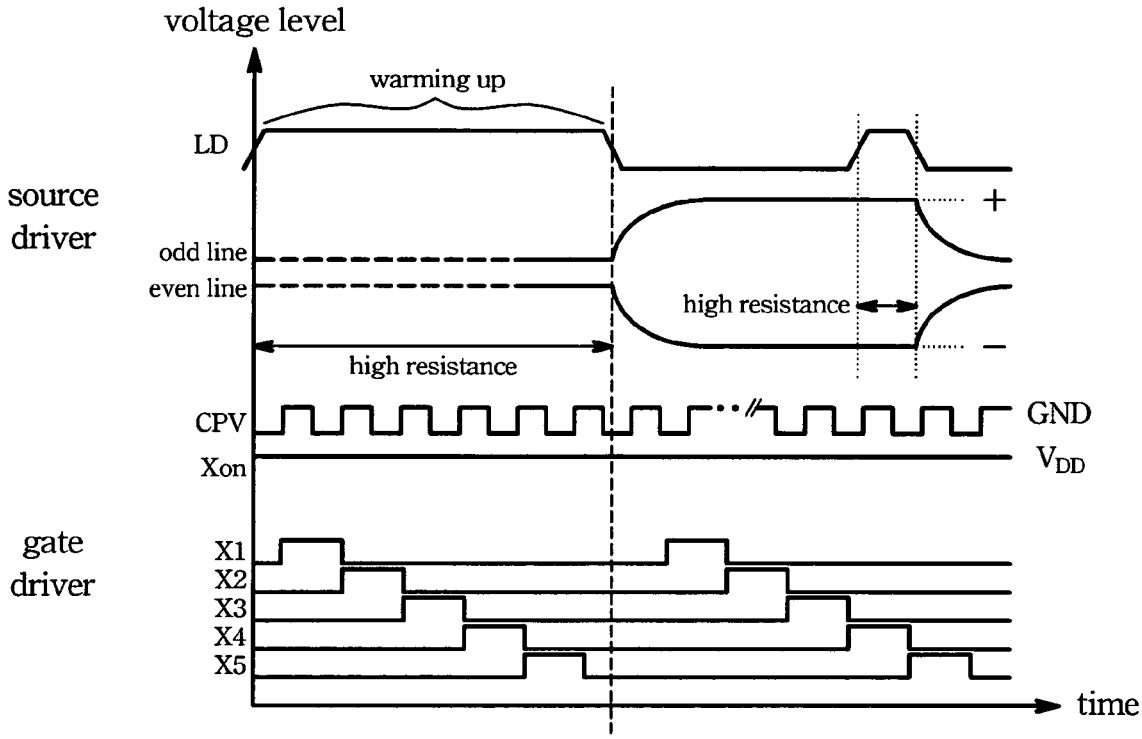
FIG. 8 illustrates the signal waveform of the source driver and the gate driver in the fifth preferred embodiment of the present invention.

FIG. 8 illustrates the signal waveform of the gate and data signals employed in the fifth preferred embodiment of the present invention. Throughout the warming-up operation of the LCD system, the data output terminal (the odd and even scan lines) of the source driver 15 is disposed at the floating state while the gate signal applied onto the gate is a pulse signal inputted into the respective scanning line (X1, X2, . . . , X5) sequentially according to the timing reference signal (CPV) such that the voltage level of the pixel electrode is substantially equal to that of the gate signal so as to enable quick transition of the molecules of the liquid crystal layer from the splay alignment into the bend alignment.

Some advantages provided by the method of the present invention are as follows:

No new circuit is required. The targeted task can be achieved by employment of the presently available gate and source drivers without deployment of a new source driver for providing high voltage to accelerate the transition of the liquid crystal molecules. In other words, by readjusting the control signal of the timing control chip, the signal waveform outputted by the gate and source drivers can be varied in order to assist in the transition of the liquid crystal molecules in the liquid crystal layer.

As is understood by a person skilled in the art, the foregoing preferred embodiment of the present invention is an illustration of the present invention rather than limiting thereon. It is intended to cover various modifications and similar arrangements included within the spirit and scope of the appended claims, the scope of which should be accorded the broadest interpretation so as to encompass all such modifications and similar structure.

We claim:

1. A method for warming-up an LCD system, wherein the LCD system includes a pixel array having a plurality of pixel units, each of the pixel units including a pixel electrode, and a TFT (thin film transistor) provided with a source and a gate such that a gate signal inputted into the gate can switch on or switch off the TFT so as to permit transfer of a data signal from the source to the pixel electrode, a common electrode being disposed oppositely to the pixel electrode, a liquid crystal layer being sandwiched between the pixel electrode and the common electrode, the warming-up method comprising the steps:

floating the source of the TFT; and applying the gate signal onto the gate which is coupled to the pixel electrode in such a manner that the pixel electrode possesses a voltage level which is substantially equal to that of the gate signal.

2. The warming-up method according to claim 1, wherein the LCD system is an OCB (Optically Compensated Bend) mode LCD system, the pixel electrode with the voltage level enabling a quick transition of liquid crystal molecules in the liquid crystal layer from a splay alignment into a bend alignment.

3. The warming-up method according to claim 1, wherein the LCD system includes a data line and a source driver which is coupled to the source of the TFT via the data line, the source driver capable of interrupting the transfer of the data signal so as to cause the floating of the source of the TFT.

4. The warming-up method according to claim 3, wherein the LCD system further includes a plurality of scanning lines and a gate driver coupled to the respective TFTs of the pixel array via a respective one of the scanning lines.

5. The warming-up method according to claim 4, wherein the gate signal is a pulse signal which is formed and inputted into the respective TFTs via the respective one of the scanning lines one by one in accordance with a cycle waveform of a timing reference signal.

6. The warming-up method according to claim 1, wherein the gate signal has a high voltage level and a low voltage level such that application of the gate signal with the high voltage level onto the gate to result in switching on of the TFT.

7. The warming-up method according to claim 6, wherein during a section of the warming-up operation, the gate signal with the high voltage level is applied ceaselessly onto the gate to result in switching on of the TFT.

8. The warming-up method according to claim 6, wherein during a section of the warming-up operation, the gate signal applied onto the gate has a cycle waveform between the high voltage level and the low voltage level.

9. A method for warming-up an OCB mode LCD system, wherein the LCD system includes a pixel array having a plurality of pixel units, each of the pixel units including a pixel electrode, and a TFT (thin film transistor) provide with a source, a drain and a gate such that a gate signal with a high or low voltage level inputted into the gate can switch on or switch off the TFT so as to permit transfer of a data signal from the source to the pixel electrode, a common electrode being disposed oppositely to the pixel electrode, a liquid crystal layer being sandwiched between the pixel electrode and the common electrode, the warming-up method comprising the steps:

(a) floating the source of the TFT during a front section of a warming-up operation, and simultaneously applying the gate signal with the high voltage level onto the gate which is coupled to the pixel electrode in such a manner that the pixel electrode possesses a voltage level which is substantially equal to that of the gate signal, wherein the pixel electrode with the voltage level enables quick transition of liquid crystal molecules in the liquid crystal layer from a splay alignment into a bend alignment; and (b) restoring the transfer of the data signal inputting the source at a rear section of the warming-up operation, and simultaneously applying the gate signal with the high voltage level onto the gate ceaselessly, thereby permitting the transfer of the data signal from the source to the pixel electrode.

10. The warming-up method according to claim 9, wherein the LCD system includes a data line and a source driver which is coupled to the source of the TFT via the data line, the source driver capable of interrupting the transfer of the data signal to cause the floating action of the source of the TFT.

11. The warming-up method according to claim 10, wherein the source driver is provided with latch up ability in order to interrupt the transfer of the data signal via the data line to the pixel electrode.

12. A method for warming-up an OCB mode LCD system, wherein the LCD system includes a pixel array having a plurality of pixel units, each of the pixel units including a pixel electrode, and a TFT (thin film transistor) provide with a source, a drain and a gate such that a gate signal with a high or low voltage level inputted into the gate can decide switch on and switch off of the TFT so as to permit transfer of a data signal to the pixel electrode via the source and the drain, a common electrode being disposed oppositely to the pixel electrode, a liquid crystal layer being sandwiched between the pixel electrode and the common electrode, the warming-up method comprising the steps:

(a) floating the source of the TFT during a front section of a warming-up operation, and simultaneously applying the gate signal with the high voltage level onto the gate which is coupled to the pixel electrode in such a manner that the pixel electrode possesses a voltage level which is substantially equal to that of the gate signal such that the pixel electrode with the voltage level enables quick transition of liquid crystal molecules in the liquid crystal layer from a splay alignment into a bend alignment; and (b) restoring the transfer of the data signal inputting the source at a rear section of the warming-up operation, and simultaneously applying the gate signal which is a pulse signal and which is formed and inputted onto the gate following a timing reference signal so as to switch the TFT on, thereby permitting the transfer of the data signal to the pixel electrode via the source and the drain.

13. The warming-up method according to claim 12, wherein the LCD system includes a data line and a source driver which is coupled to the source of the TFT via the data line, the source driver capable of interrupting the transfer of the data signal to cause the floating action of the source of the TFT.

14. The warming-up method according to claim 13, wherein the source driver is provided with latch up ability in order to interrupt the transfer of the data signal via the data line.

15. The warming-up method according to claim 12, wherein the LCD system further includes a plurality of scanning lines and a gate driver coupled to the respective TFTs of the pixel array via a respective one of the scanning lines.

16. The warming-up method according to claim 15, wherein the pulse signal is inputted onto the respective TFTs via the respective one of the scanning lines.

* * * * *